US005325648A

United States Patent [19]

Ménard

[11] Patent Number: 5,325,648

[45] Date of Patent: Jul. 5, 1994

[54] COMPOSITE EXTERIOR DOOR STRUCTURE

[75] Inventor: Jacques Ménard, Montreal, Canada

[73] Assignee: Michel Hébert, Delson, Canada

[21] Appl. No.: 871,030

[22] Filed: Apr. 20, 1992

[51] Int. Cl.[5] ..... E06B 3/70

[52] U.S. Cl. ..... 52/456; 52/455; 52/209; 52/775; 49/471; 49/501

[58] Field of Search ..... 52/455, 456, 656.1, 52/209, 775; 49/471, 467, 469, 470, 501

[56] References Cited

U.S. PATENT DOCUMENTS

| | | | |
|---|---|---|---|
| 2,570,336 | 10/1951 | Fouts | 49/471 X |
| 3,512,304 | 5/1970 | Meuret | 52/456 |
| 3,638,372 | 2/1972 | Rosenthal | 52/209 X |
| 3,885,351 | 5/1975 | Imperial et al. | 49/501 |
| 3,903,669 | 9/1975 | Pease, Jr. et al. | 52/455 |
| 3,949,526 | 9/1976 | Scherlock et al. | 49/501 |
| 4,310,991 | 1/1982 | Seely | 49/471 X |
| 4,411,104 | 10/1983 | St. Aubin | 49/467 X |
| 4,513,536 | 4/1985 | Giguère | 49/470 |
| 4,747,248 | 5/1988 | Fahs | 52/455 |
| 4,831,779 | 5/1989 | Kehrli et al. | 49/471 |
| 5,022,206 | 6/1991 | Schield et al. | 52/455 |
| 5,067,279 | 11/1991 | Hagemeyer | 49/471 |
| 5,136,814 | 8/1992 | Headrick | 49/471 X |

FOREIGN PATENT DOCUMENTS

| | | |
|---|---|---|
| 1033620 | 6/1978 | Canada . |
| 2006287 | 6/1991 | Canada . |

*Primary Examiner*—Carl D. Friedman
*Assistant Examiner*—Robert J. Canfield

[57] ABSTRACT

A composite exterior door structure comprising an inner frame of transversely connected elongated structural members formed of synthetic low thermally conductive material. The structural members have opposed parallel flat side walls and edge walls, the latter being formed with connecting channels. The structural members are interconnected to form a rectangular frame. Connectors of low thermally conductive material are connected to the connecting channels of inner ones of the edge walls of the structural members. An outer metal door covering is connected over an outer one of at least some of the opposed parallel flat side walls of the structural members and the connectors by displaceable connections to permit the outer door covering to shift due to expansion and contraction independently of the structural members. An inner door covering is immovably secured to an inner one of the opposed parallel flat walls and thermally insulated from the outer door covering.

18 Claims, 5 Drawing Sheets

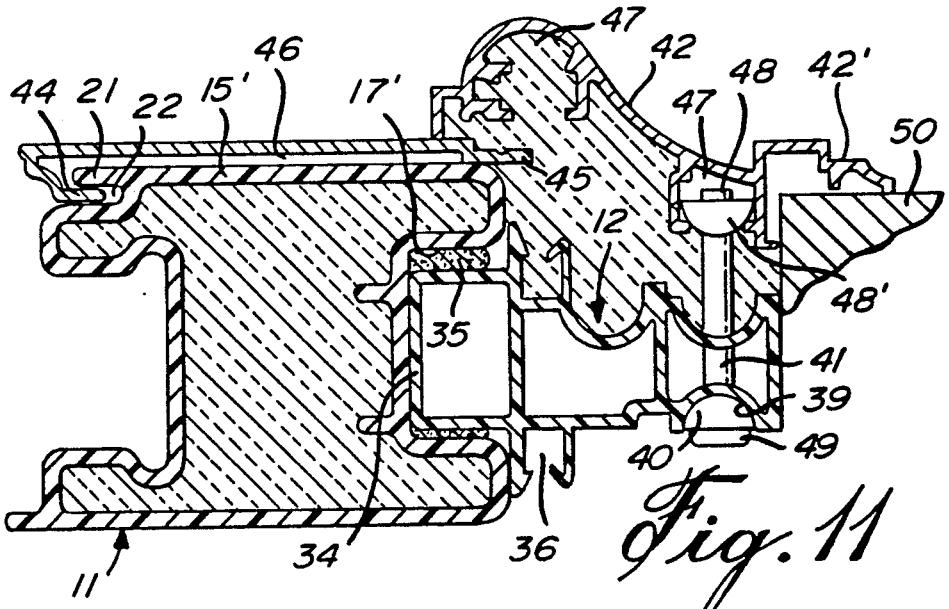
Fig. 11
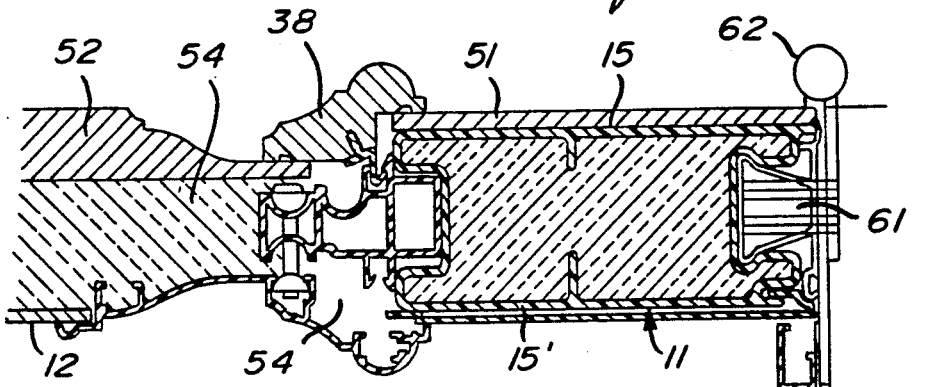
Fig. 12
Fig. 13
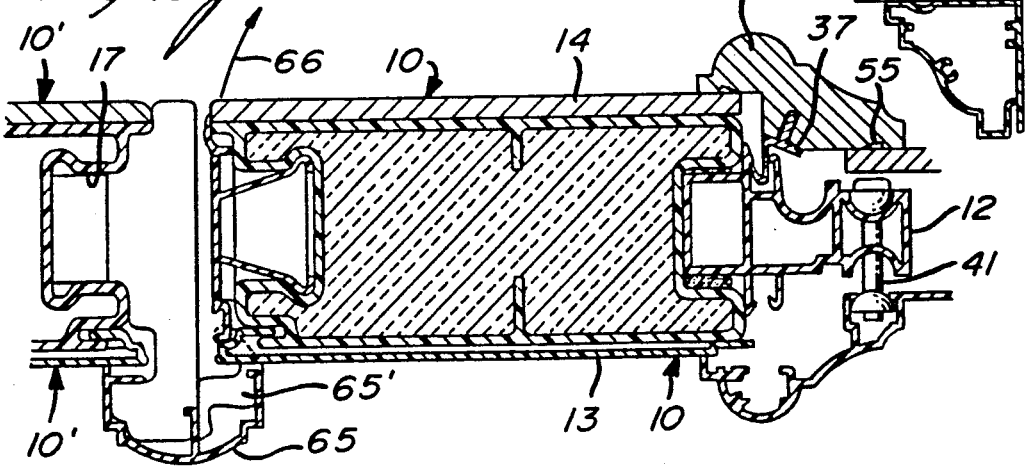

COMPOSITE EXTERIOR DOOR STRUCTURE

BACKGROUND INVENTION

1. Field of Invention

The present invention relates to a composite exterior door structure which comprises an inner frame of structural members formed of synthetic low thermally conductive material and wherein the door has an outer door covering of metallic material which is secured to permit expansion and contraction thereof independently of the structural members, and further wherein an inner door covering in immovably secured to the structural members and is thermally insulated from the outer door covering.

2. Description of Prior Art

There exists various types of exterior doors for use primarily in residential structures. In the past twenty years the construction of such doors has greatly evolved from the traditional wooden door to composite door structures. The reason for this change is that the traditional wooden door was found to have important disadvantages, and namely that it requires considerable maintenance and provides poor insulation. It is also relatively expensive to fabricate and maintain large inventories of these wooden doors or other type doors to satisfy the consumer demand. A further disadvantage of such exterior doors is that they often require the installation of a storm door in front of them to provide better insulation and to protect the door from the effects of inclement weather.

Composite wooden door structures are know and some are constructed with pressed polyurethane panels secured to a wooden frame. However, like the wooden door these are still subject to warping as the wood absorbs humidity, and the doors still require maintenance, such as repainting. Likewise, laminated wood doors are subjected to the same disadvantage even if the core of the door is formed of polyurethane. A further disadvantage with these laminated doors is that there is a limit as to how much window space can be provided in the door.

Another type of exterior door which has become popular is the steel door insulated with an inner polyurethane core. However, with these doors very few models are offered because of the cost of the molds which shape the metal sheet to simulate door stiles and panels. It is also required to maintain a large inventory of these doors to offer the existing designs in various standard door dimensions. The stocking of these doors is expensive. These known steel doors are also subjected to distortion due to expansion and contraction of the metal caused by the change in temperature, and this causes the door structure to warp further causing secondary problems, such as poor insulation with the door frame. The aesthetics of many of these steel doors is limited due to the cost of providing a large inventory of motifs. Also, screw heads which secure the weather sealing door bottom to the interior of the door frame are usually apparent from the outer face of the steel covering and this degrades the quality of the door. However, these doors generally offer good insulation with the exception of those that have motifs pressed therein making portions of the door very thin. Metal doors are usually constructed with inner and outer metal surfaces connected to an inner core, and the spaces therebetween are filled with an insulating foam, such as polyurethane. A further disadvantage of such doors is that the interior surface covering of the door is also metal and this reflects a "cold" feeling to the interior surface and surrounding space.

Fiber doors are also known, and these are also insulated with a polyurethane inner core and they have generally the same disadvantages as the steel doors, although they provide better peripheral insulation and are less subjected to warping as they do not absorb humidity as with steel doors having wooden inner frames, but still most of the models maintain the use of wooden frames.

Finally, some European products do approach the type of construction disclosed herein, but are not of the composite type, as they usually are constructed of a thermally broken aluminum or PVC tubular perimeter with "glazed in" insulated panels or glass units. The perimeter tube, because of its construction, is not filled with insulation as the present invention.

SUMMARY OF INVENTION

It is a feature of the present invention to provide an improved composite exterior door structure which substantially overcomes the disadvantages of the prior art, and which provide additional features for the exterior as well as the interior surface coverings of the door while providing an inner core which has superior insulating characteristics.

Another feature of the present invention is to provide an exterior door structure having improved construction flexibility permitting various designs to be realized without having to stock a great variety of doors.

Another feature of the present invention is to provide a composite exterior door structure wherein the outer door covering is formed from metal components which are connected to provide expansion and contraction independently of the inner frame or inner covering of the door.

Another feature of the present invention is to provide a composite exterior door structure having an inner frame which is formed of an innert synthetic low thermally conductive material which is substantially not affected by temperature as is glass, and which has an inner insulating core completely isolating the outer door covering from the inner door covering.

Another feature of the present invention is to provide a composite exterior door structure having a metal outer door covering and a wooden inner door covering and wherein the inner wooden door covering may be comprised of various types of wood.

Another feature of the present invention is to provide a composite exterior door structure wherein a great variety of door panels or panes and moldings may be adapted to the structure to provide a large number of door designs and wherein all connectors are concealed from the outer face of the outer and inner coverings.

Another feature of the present invention is to provide a composite exterior door structure having an inner frame of inert synthetic low thermally conductive material with an outer door covering of aluminum connected thereto, and wherein the door frame is not affected by the expansion and contraction of the aluminum thus substantially eliminating warping of the door thereby maintaining a good thermal seal between the door and the door frame.

Another feature of the present invention is to provide a composite exterior door structure in combination with a door sill having a sill insert member formed of stone, and providing good insulation and drainage of water seapage.

Another feature of the present invention is to provide a composite exterior door structure having the appearance of a solid wooden door and the advantageous features of metal doors and wherein such composite exterior door structure is less expensive to fabricate than quality steel doors with elaborate glazing units.

A still further feature of the present invention is to provide a composite exterior door structure having an improved thermal insulating factor as compared to steel doors of the prior art and wherein the exterior of the door requires very little maintenance.

According to the above features, from a broad aspect the present invention provides a composite exterior door structure which comprises an inner frame of transversely connected elongated structural members formed of synthetic low thermally conductive material. The structural members have opposed parallel flat side walls and edge walls formed with connecting means. Means is provided to interconnect the structural members to form a rectangular frame. Connectors of low thermally conductive material are connected to the connecting means of the inner ones of the edge walls of the structural members. An outer metal door covering is connected over an outer one of at least some of the opposed parallel flat side walls of the structural members forming the rectangular frame and the connectors by displaceable connections to permit the outer door covering to shift due to expansion and contraction independently of the structural members. An inner door covering is immovably secured to the rectangular frame and thermally insulated from the outer door covering.

According to a still further broad aspect of the present invention there is provided a door sill in combination with a bottom step plate of an exterior door frame. The door sill comprises a metal support plate having an outwardly downward sloping elevated upper surface. A connector is formed in a rear edge of this support plate and defines an open ended edge channel for receiving captive an edge portion of a sill insert member secured on the upper surface. A door frame bottom step plate of synthetic material is provided with an edge connector for attachment with the metal support plate.

BRIEF DESCRIPTION OF DRAWINGS

A preferred embodiment of the present invention will now be described with reference to the accompanying drawings in which:

FIG. 11 is an enlarged cross-section view illustrating the construction of the low thermally conductive connectors and showing its interconnection with a structural member and to a metal clamping strip via a displaceable connection;

FIG. 12 is an enlarged section view illustrating the hinge connection to the connecting cavity in the outer end wall of a structural member; and FIG. 13 is a section view illustrating the joint structure of two composite exterior doors connected in side-by-side planar alignment, such as in a French or terrase door arrangement.

Figure 1A:
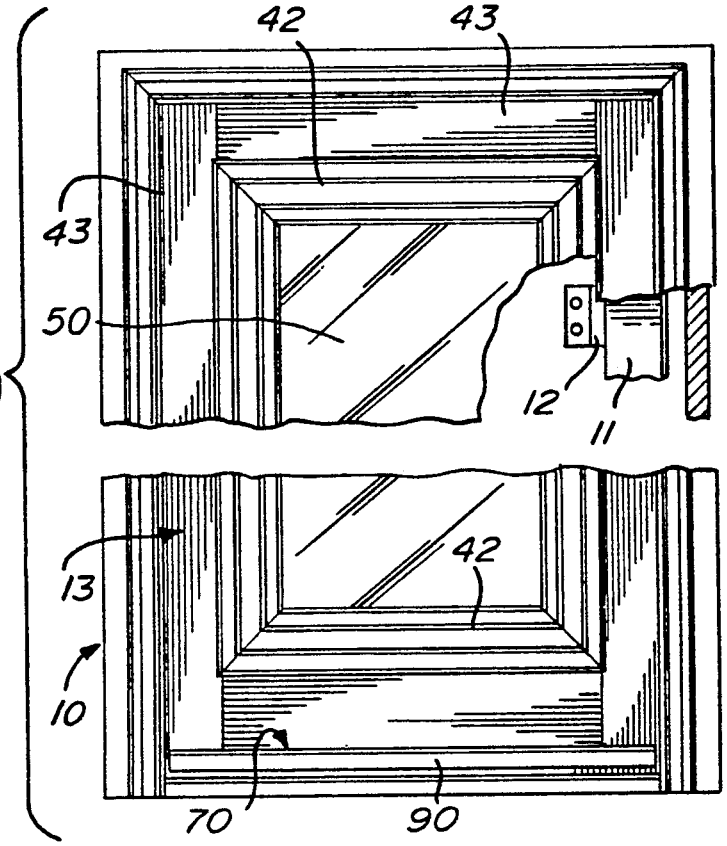
FIGS. 1A and 1B are plan views, partly fragmented, of the composite exterior door structure of the present invention illustrating the outer and inner door coverings thereof.
Figure 1B:
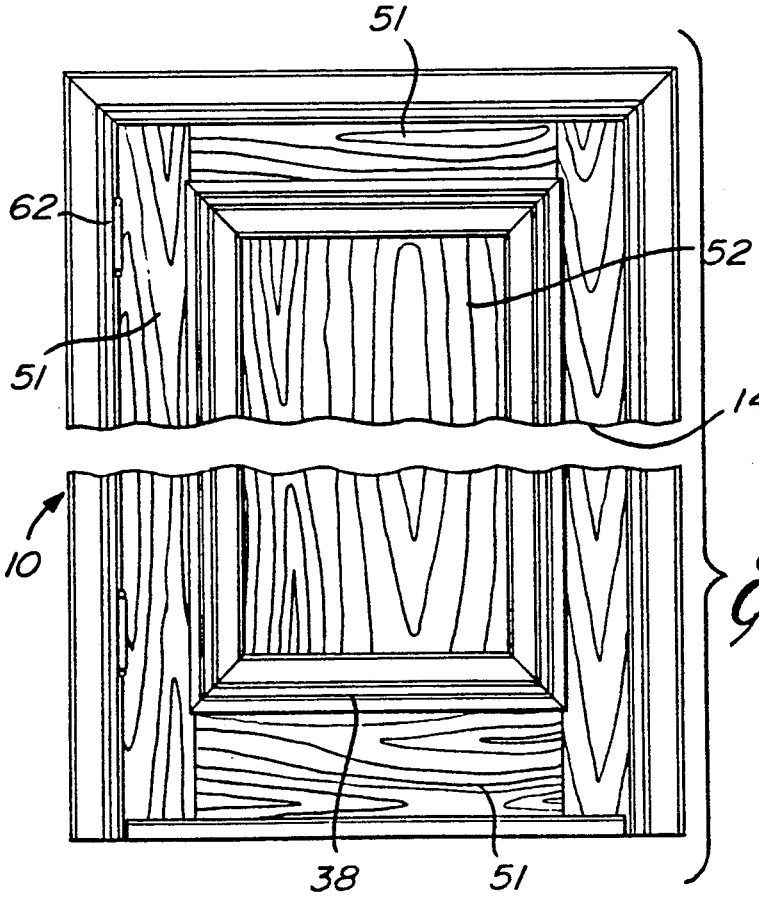

DESCRIPTION OF PREFERRED EMBODIMENTS:

Referring to the drawings, and more particularly to FIGS. 1A and 1B, there is shown generally at 10 the composite exterior door structure of the present invention. Basically, the composite exterior door structure is comprised of an inner frame formed of transversely connected elongated structural members 11 which are formed of synthetic low thermally conductive material, herein a fiber composition which is an inert material. Connectors 12 are secured to the structural frame for a purpose, as will be described later. An outer metal door covering 13 is secured by displaceable connections to the frame and connectors in the manner wherein the outer door covering can be displaced due to expansion and contraction of the metal members independently of the structural members 11. The outer covering 13 may also be formed from synthetic materials that are also subjected to thermal expansion and contraction. The inner door covering 14 shown in FIG. 1B is constituted by thin natural wood planks, moldings, panels, or thermo glass panes (not shown), but as will be described later with reference to FIG. 4. Accordingly, the composite exterior door structure of the present invention is characterized by an outer metal covering which is movably connected to an inert structural inner frame, and an inner door covering is formed of natural wood and thermally insulated from the outer metal door covering.

Figures 2, 3, 5:
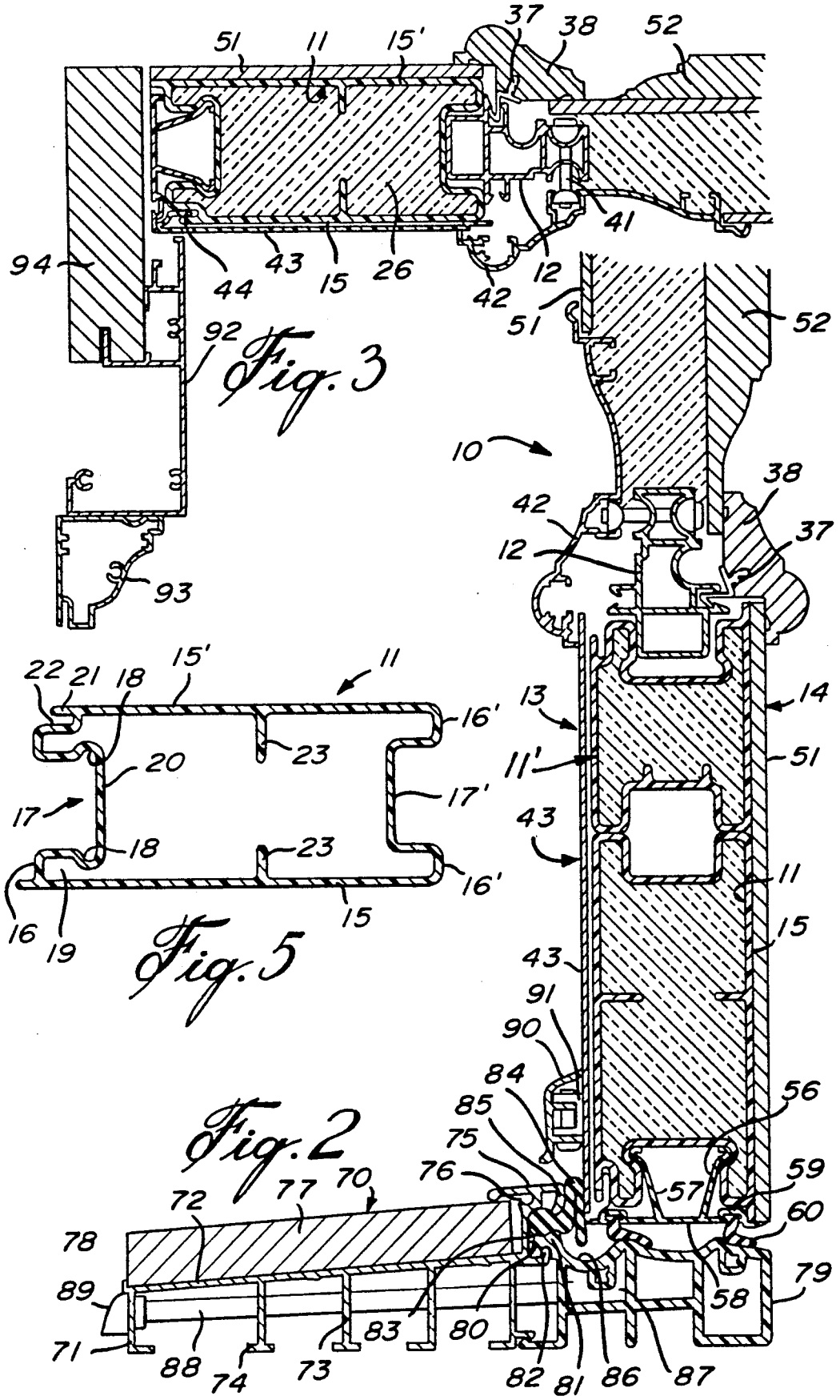
FIG. 2 is a section view illustrating the composite construction of the door structure and a novel door sill design.
FIG. 3 is a section view illustrating the composite exterior door structure of the present invention, but as seen through a butte stile section of a door and a panel section.
FIG. 5 is a section view through one of the elongated structural members.
Figures 4, 6, 7:
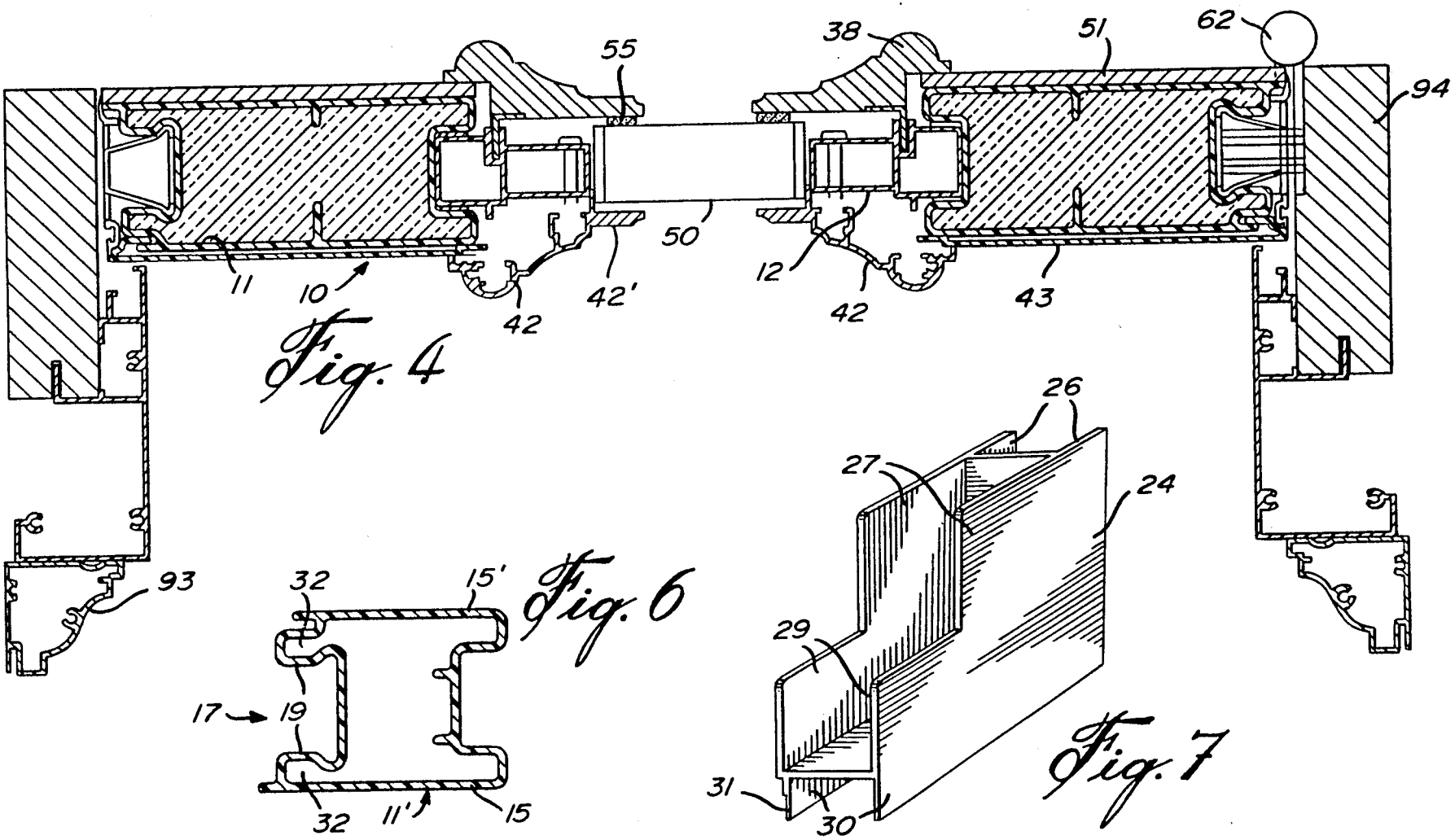
FIG. 4 is a horizontal section view through a composite exterior door structure of the present invention having a thermal pane therein, and illustrating the securement of hinges and seals.
FIG. 6 is a view similar to FIG. 5, but through a member of narrower width.
FIG. 7 is a perspective view of a corner connector for the structural members.
Figure 8A:
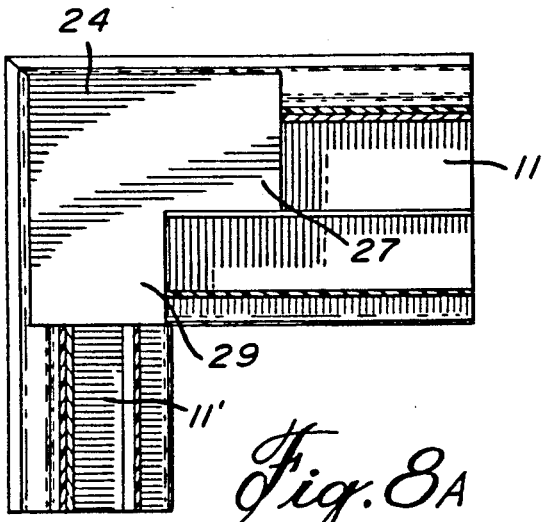
FIG. 8A is a plan view showing the corner connector of FIG. 7 transversely interconnecting edge structural members together.
Figure 8B:
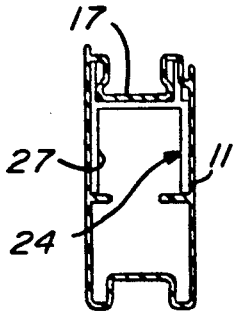
FIGS. 8B and 8C are end views along both interconnected structural members of FIG. 8A.
Figure 8C:
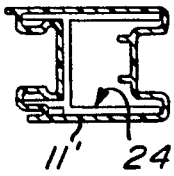

Referring now additionally to FIGS. 2 to 13, there will be described the detailed construction of the composite exterior door structure of the present invention. As shown in FIGS. 5 and 6, the structural members 11 are hollow pultrusions of synthetic low thermally conductive fiberglass composition, as previously mentioned, and defines opposed parallel flat side walls 15 and 15' and edge walls 16 and 16'. The edge walls are provided with connecting cavities 17 and 17' which constitute connecting means for connecting to other door elements, as will be described later. The connecting cavity 17' is of a U-shape cross-section as is the cavity 17, but the cavity 17 has bottom recesses 18 in the side walls 19 thereof and adjacent the cavity bottom wall 20. The side wall 15' of the structural member 11 is also provided with a flange extension 21 defining a connecting slot 22 therebehind to provide a displaceable connection with the metal outer door covering, as will be described later.

FIG. 6 illustrates a structural member 11' which is of narrower width than that shown in FIG. 5. However, the structural member 11 of FIG. 5 is provided with inner strengthening ribs 23 due to the larger span of its opposed side walls 15 and 15' whereas this is not necessary for the narrow width structural member of FIG. 6. Structural members may also be formed of intermediate widths if necessary, but these two members have been found adequate to construct a great variety of door frames. As shown in FIG. 2, a narrow structural member 11', is held captive between a door bottom structural member 11, which is connected to other side structural members 11 (as is obvious), and the molding 38 and clamping 42, as will become obvious later.

Figure 9B:
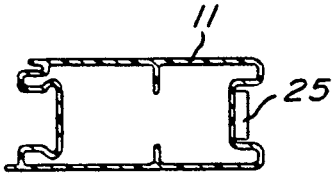
FIGS. 9B and 9C are end view along the end structural members and intermediate structural members, respectively.
Figure 9A:
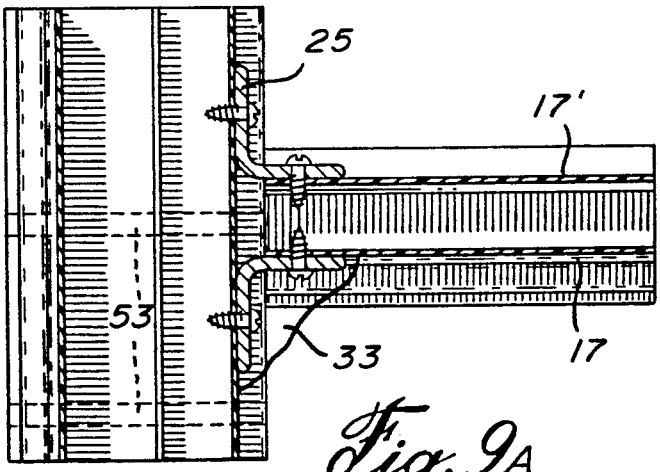
FIG. 9A is a plan view showing the interconnection of an intermediate structural member to an edge structural member.
Figure 9C:
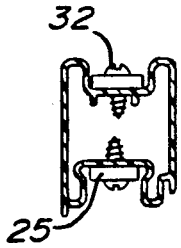

The structural members of FIGS. 5 and 6 are interconnected transversely at their ends by right angle or 45°-connections to form a rectangular inner door frame. These interconnections are realized by right-angle corner connectors 24, as shown in FIG. 7, or intermediate L-shape transverse connectors 25, as shown in FIG. 9A. Also, these hollow structural members are injected with a polyurethane foam 26 (as shown in FIG. 3) after the composite door structure has been assembled, and this foam flows in between the corner connectors and also on top of the intermediate transverse connectors between the door frame and to all of its connecting parts over and above its primary insulating purpose.

Referring now more specifically to FIGS. 7 to 9C, it can be seen that the corner connector 24 is a right-angle connector and defines a pair of spaced apart connecting plates 27 and strengthening plates 26 aligned therewith and extending along one arm of the right angle connector 24. The other arm has likewise connecting plates 29 of smaller dimension, as this connector will be connecting structural members of both dimensions as shown in FIGS. 5 and 6. The connecting plates 29 are also aligned with strengthening plates 30. As herein shown, one of the plates 30 and 26 has a step wall 31, and these are provided to extend within the cavities 32 located behind the side walls 19 of the connecting cavities 17 and 17' of these structural members 11 and 11'. This adds further strength to the side walls of the connecting cavities, as is better shown in FIGS. 8B and 8C. The corner connectors 24 are secured to the structural members 11 and 11, by fasteners, such as at 32 in FIG. 9C, and by the use of an adhesive to achieve maximum rigidity at the connection. The manner in which the connector is secured is illustrated in FIG. 8A and this is obvious to a person skilled in the art.

As shown in FIG. 9A, the intermediate transverse connectors 25 are simply L-shape flat fiberglass material brackets and are secured to the connecting cavities 17 or 17' by fasteners 32 which are later insulated when the polyurethane foam is injected within the cavities formed between the outer and inner door coverings 13 and 14 respectively. A glob of glue 33 may also be applied over these internal transverse connectors 25 to add further rigidity between the interconnected structural members while at the same time sealing the connector 25.

Once the inner door frame is constructed with transversely interconnected structural members and in accordance with a door design specification, rectangular openings are provided for securement of door panels or thermo-glass panes, or a combination of both, the connectors 12 are then secured into the connecting cavities 17 or 17'. These connectors 12 are better illustrated in FIG. 11 and are constructed of low thermally conductive material, such as polyvinyl chloride plastics, and consist of an extrusion which is cut into small block sections and define a base 34 which is herein shown connected in the connecting cavity 17' by means of glue 35. The connector 12 is also provided with opposed connecting channels 36 for receiving an inner molding snap connector 37 as shown in FIG. 2, to attach an inner wooden molding 38 thereto so that no nails or screws are necessary to attach the inner door covering to the door frame. The connector 12 is further provided with opposed arcuate channels 39 to receive semi-spherical washers 40 which are threadedly secured to a nylon fastener 41. This nylon fastener 41 is used to connect the metal clamping strip members 42 of the outer metal door covering to the structural members 11 and insulated therefrom, as is clearly shown in FIG. 11.

Figure 10:
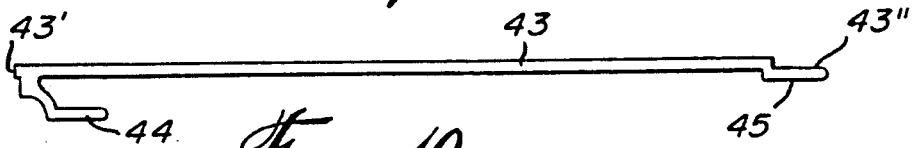
FIG. 10 is a cross-section view of an extruded metal member forming part of the outer door covering.

With reference to FIG. 10 and further reference to FIG. 11 and FIGS. 2 to 4, the outer door covering is comprised of extruded metal members 43 (see FIG. 10) which are elongated rectangular aluminum plates, and these are connected over an outer one of the side walls, herein side wall 15' of the structural members 11 of the door frame. The flat rectangular plates 43 are formed with a tongue 44 extending behind an outer edge 43' thereof which is located within the connecting slot 22 behind the flange edge 21 of the outer wall 15', but in clearance fit therein to provide a slip-joint connection for future expansion and contraction of the metal plate 43. As the plates 43 expand or contract the tongue 44 will move within the slot 22 which is concealed behind the plate and the plate is maintained engaged with the structural member 11. The opposed end edge 43" of the plate 43 is formed with a step edge portion 45, and this maintains the plate 43 spaced above the outer surface of the side wall 15' to provide an air gap 46 therebetween.

As shown in FIG. 11, the metal clamping strip 42 is an aluminum extrusion which can have a variety of molding contours to simulate various wooden molding designs. By stocking these extrusions various door designs and size variations can be provided inexpensively. These clamping strip members are provided with connecting channels or cavities 47 formed integral therebehind to accommodate a semi-spherical washer 48' secured to the nylon fastener 41 at the free end 48 thereof. Accordingly, the clamping strip is placed in position by locating the washer 48' inside the cavity 47 and threading the head 49 of the nylon fastener from the back side of the frame which is not yet covered. The clamping strip 42 is further provided with an edge clamp portion 42' to receive a corner portion of a thermo glass pane 50 or an ornamental door panel 52, as shown in FIGS. 4 and 11. Once the outer metal door covering is assembled the next step is to secure the inner wall covering to the door frame.

Referring to FIG. 2, the inner door covering consists of wooden parts, glued to the frame and connected to the connectors, as previously described to simulate a full wooden door structure when viewed from behind. Accordingly the wooden parts consist of wooden panels 51 simulating door rails glued to the side walls 15 of the structural members 11, wood moldings 38 and ornamental door panels 52 interconnected together and to the opening(s) of the frame by snap connectors 37. Accordingly, no screws or nail heads are visible on the inner wall covering. A preformed polyurethane panel 52 of suitable thickness is used to cover most of the door openings. Once the total assembly is completed as shown in FIGS. 2, 3 and 4, holes 53 are drilled through some of these structural members, as shown in FIG. 9A, and foam is injected inside the remaining spaces 95 between the outer and inner coverings, the preformed polyurethane panel and the hollow structural members 11. The insulating foam adheres surrounding part forming the spaces 95 and bonds them together, such as the clamping strips 42, the connectors 12, the door panels or surrounding thermo-glass pane 50, as shown in FIG. 4. When thermo glass panes are utilized, or otherwise for securing the moldings 38 and door panels 52 double-side adhesive tape 55 is disposed at selected locations. These tapes are also used to secure the metal clamping strip 42 to the metal members 43, during assembly in a manner well known in the art. However, when the polyurethane is injected in the spaces 95 between the doors, all of these elements become solidly and immovably interconnected to one another by the polyurethane and bonded to the rigid peripheral frame which has become even more rigid by the injection of polyurethane within its hollow space.

After the composite exterior door structure is completed, various hardware can now be connected to the peripheral outer cavities 17 and 17' of the frame. As shown in FIG. 2, an elongated insert 56 having opposed flexible connecting arms 57 is snap-fitted along the cavities at desired locations and retained therein by the constant outward pressure. The flat outer wall 58 of the insert 56 is provided with opposed connecting channels 59 in which insulating weather stripping is fitted to provide a double or a single seal around the door periphery. Locks or bolting structures are also mounted within the rear vertical edge cavity 17 depending on the requirements. Hinge connecting blocks 61 (FIG. 12) are also fitted within these cavities to connect door hinges 62 thereof. As shown in FIG. 12 the connecting blocks have a conical shape and are mounted within the inserts 56, so that when the hinge 62 is screwed therein the block 61 imparts a wedging action within the connecting cavity 17 to provide a solid connection.

FIG. 13 further illustrates the connection of a vertical trim 65 along an edge of one of two opposed composite doors 10 and 10' secured side by side in a frame, not shown. The vertical trim is secured to the connecting cavity 17 of the door 10' and provided with a seal 65'. The other door 10 moves into sealing engagement with the trim 65, for example, in the direction of arrow 66. This casing trim 65 is constructed to provide a thermal barrier between the outer and inner door coverings and also also permits expansion of the metal outer covering 13.

Referring again to FIG. 2, there will now be described the construction of the door sill 70 which is assembled at the bottom end of the door frame surrounding the composite door structure 10 of the present invention. The door sill, as herein shown, is comprised of a metal extruded support plate 71 having an outwardly downward sloping elevated upper surface 72 supported by a plurality of parallel support ribs 73 having bottom flange 74 which are embedded into the top surface of granite when the door frame is installed together with the integral sill. An elongated connector 75 is formed in a rear edge above the support plate upper surface 72 and defines an open ended edge channel 76 for receiving captive therein an edge portion of a sill insert, herein a granite rectangular sill slab 77. A right angle retention edge 78 is formed in the forward end edge of the support surface 72. The granite slab 77 is secured by glue which may be provided in the forward end edge thereof and concealed within the edge channel 76. Glue is also provided to secure the granite slab 77' to the top of plate 72.

A door frame bottom step plate 79 of extruded synthetic material is connected to the support plate 71 in a retention cavity 80 formed integrally with the elongated connector 75. The step plates 79 has an edge connection 81 formed therewith which locates within the cavity 80 and receives a connecting rib 82 of the connector 75 within a slot 83 formed with the connecting edge. A door bottom rail flexible sealing strip 84 is also secured within the cavity 80 and retained captive therein between the flange 85 and the edge connector 81.

As herein shown, the step plate 79 also has an elongated trough 86 extending along a top forward edge portion thereof. This trough is provided with a plurality of holes (not shown) therealong and communicates with the inner chamber 87 formed thereunder. One or more drain pipes 88 connects to the inner chamber and extends under the metal support plate to discharge water that may find its way into the trough 86 and the chamber 87, and discharge it forwardly under the door sill through the spout 89. As also shown in FIG. 2, a drip plate 90 is connected along a lower edge of the composite door structure and secured to attachment brackets 91 which are glued, welded or otherwise fastened, to the metal plate 43 to cause water flowing on the outer metal surface to drip onto the top wall of the connector 75 and down on the outer face of the granite slab 77. Of course, any other suitable slab may be used for the door sill. As also shown in FIG. 3, other aluminum extrusion parts, such as the casing trim 92 or decorative molding 93, may be utilized to construct a resistant outer door frame. The casing extrusion 92 is connected to the inner wooden door frame upright.

It is within the ambit of the present invention to cover any other obvious modifications of the preferred embodiment described herein, provided such modifications fall within the scope of the appended claims.

I claim:

1. A composite exterior door structure comprising an inner frame of transversely connected elongated structural members formed of synthetic low thermally conductive material, said structural members having opposed parallel flat side walls and edge walls, said edge walls being formed with connecting means, means to interconnect said structural members together to form a rectangular frame, connectors of low thermally conductive material connected to said connecting means of inner ones of said edge walls of said structural members, an outer metal door covering connected over an outer one of at least some of said opposed parallel flat side walls of said structural members forming said rectangular frame by displaceable connections, said connections being concealed behind said metal door covering and permitting said outer door covering to shift due to expansion and contraction thereof while remaining connected to said structural members, and an inner door covering immovably secured to said rectangular frame and thermally insulated from said outer door metal covering.

2. A composite exterior door structure as claimed in claim 1 wherein structural members are hollow members formed of an inert synthetic material and an insulting foam material is disposed in said hollow members and in spaces bordered by said structural members between said outer and inner door covering to form an insulated core in said door to maintain said various component parts of said door interconnected together.

3. A composite exterior door structure as claimed in claim 2 wherein said outer metal door covering is comprised of flat sheet metal members and metal clamping strip members connected to said structural members by said displaceable connections.

4. A composite exterior door structure as claimed in claim 3 wherein said flat sheet metal members ar flat rectangular plates connected to said structural members forming said rectangular frame by slip-joint connections, said flat sheet metal members extending over said structural members.

5. A composite exterior door structure as claimed in claim 4 wherein said metal clamping strip members are connected to said connectors of low thermally conductive material by fasteners having a threaded stem of thermally non-conductive material, said fasteners having opposed connecting heads attachable to a connecting cavity in a rear wall of said strip member and to said connectors to permit lateral displacement of said stem by said shifting of said outer door covering.

6. A composite exterior door structure as claimed in claim 5 wherein said thermally conductive door elements comprises ornamental panels or thermo glass-panes.

7. A composite exterior door structure as claimed in claim 4 wherein said slip connections comprise an elongated flange of L-shape cross-section formed adjacent an edge of said flat rectangular plates and extending spaced a predetermined distance over a rear wall thereof, said flange extending into an edge channel formed behind an outer flat wall of said structural members and along an edge thereof to constitute said slip-joint connections.

8. A composite exterior door structure as claimed in claim 7 wherein at least some of said flat rectangular plates are further secured to each other, said at least some of said plates having free edge portions thereof retained under edge portions of said clamping strip members.

9. A composite exterior door structure as claimed in claim 6 wherein said inner door covering is comprised of wood pieces including flat rectangular boards glued to an inner flat side wall of said transversely connected structural members to define door rail portions, wooden moldings secured to said connectors of low thermally conductive material for securing wooden panels or surrounding said thermo-glass panes in spaced insulating relationship.

10. A composite exterior door structure as claimed in claim 9 wherein said means to interconnect said structural members are right angle connectors, said connecting means of said edge walls being comprised by connecting channels formed in said edge walls, said connecting channel of an outer one of said edge walls accommodating one or more snap connector strips of securement of sealing gaskets, and connecting block for securement of hinges, bolt plates and other door hardware components.

11. A composite exterior door structure as claimed in claim 1 in combination with a door sill, said door sill being comprised by a metal support plate having an outwardly downward sloping elevated upper surface, a connector formed in a rear edge of said support plate and defining an open ended edge channel for receiving captive therein an edge portion of a sill insert member secured on said upper surface, and a door frame bottom step plate of synthetic material having an edge connector secured in said open ended edge channel of said metal support plate, said step plate being secured between side frame members of a door fame adapted to retain a door.

12. A composite exterior door structure as claimed in claim 11 wherein a door bottom rail seal strip is secured in a retention cavity defined by a portion of a connecting slot extending along a rear wall of said open ended channel and said edge connector of said step plate which is secured to said connecting slot.

13. A composite exterior door structure as claimed in claim 12 wherein said step plate is formed of plastic material and defines a trough along a top forward edge portion thereof, said trough having holes therein communicating with an inner chamber of said step plate, and one or more drain pipes connected to said inner chamber and extending under said metal support plate to discharge water from said chamber forwardly of said door sill.

14. A composite exterior door structure as claimed in claim 11 wherein said sill insert member is a stone slab.

15. A door sill in combination with a bottom step plate of an exterior door frame, said door sill comprising a metal support plate having an outwardly downward sloping elevated upper surface, a connector formed in a rear edge of said support plate and defining an open ended edge channel for receiving captive therein an edge portion of a sill insert member secured on said upper surface, said step plate being formed of synthetic material and having an edge connector secured in said open ended edge channel of said metal support plate.

16. A door sill as claimed in claim 15 wherein a door bottom rail seal strip is secured in a retention cavity formed by a portion of a connecting slot extending along a rear wall of said open-ended channel and said edge connector secured to said connecting slot.

17. A door sill as claimed in claim 16 wherein said step plate is formed of plastic material and defines a trough along a top forward edge portion thereof, said trough having holes therein communicating with an inner chamber of said step plate, and one or more drain pipes connected to said inner chamber and extending under said metal support plate to discharge water from said chamber forwardly of said door sill.

18. A door sill as claimed in claim 17 wherein said sill insert member is a stone slab.

* * * * *